US005083718A

United States Patent [19]

Chen

[11] Patent Number: 5,083,718

[45] Date of Patent: Jan. 28, 1992

[54] AUTOMATIC MATERIAL EXTENSION MACHINE

[75] Inventor: Sheng-Ming Chen, Tainan City, Taiwan

[73] Assignee: Pro Accutech Co., Ltd., Taipei, Taiwan

[21] Appl. No.: 548,790

[22] Filed: Jul. 6, 1990

[51] Int. Cl.[5] ..... B65H 19/18

[52] U.S. Cl. ..... 242/58.1

[58] Field of Search ..... 242/58.1, 58.2, 58.3, 242/58.4, 58.5, 58.6, 68.7, 66

[56] References Cited

U.S. PATENT DOCUMENTS

| | | | |
|---|---|---|---|
| 3,195,827 | 7/1965 | Schowerer | 242/58.2 |
| 3,345,011 | 10/1967 | Martin, Sr. | 242/58.6 |
| 3,467,334 | 9/1969 | Chesnut et al. | 156/504 X |
| 3,529,785 | 9/1970 | Mistele | 242/64 |
| 3,831,876 | 8/1974 | Phelps et al. | 242/58.3 |
| 4,135,674 | 1/1979 | Bartmann | 242/66 X |
| 4,466,577 | 8/1984 | Focke et al. | 242/58.1 X |
| 4,829,918 | 5/1989 | Young, Jr. | 242/58.4 X |
| 4,880,178 | 11/1989 | Goulette | 242/58.4 X |
| 4,936,942 | 6/1990 | Sollinger et al. | 242/58.3 X |

*Primary Examiner*—Daniel P. Stodola
*Assistant Examiner*—John P. Darling
*Attorney, Agent, or Firm*—Browdy and Neimark

[57] ABSTRACT

The present disclosure is related to an automatic material extension machine, and more particularly to a rotatable abutment type extension machine adapted for continuously drawing out rolled up material mounted on rolls by friction for further processing; which includes an abutment balance transmitter and an automatic end-joining device, and is mainly applied to tape, wall paper and leather substance prepared in rolls. The abutment extension transmitter has two sets of developing rollers on which are disposed the rolls ready to be operated; one of the sets is identified as action set and the other is called stand-by set; the former uses driving motor to actuate two cylinders which are in abutment with the roll of material so to make the rolled-up material outwardly extended by friction. When the roll on the action set is about to run out, the front end of the stand-by roll set is made to automatically join end-to-end to the final end of the action roll set; in the meanwhile, the two sets of developing roller are forced by a motor to make an 180 degree turn for shift of position. The mechanism effecting the shift is made up of five identical gears which control respectively the external frame of the developing rollers to turn 180 degrees and constantly keep the horizontal brackets of the two sets of roller in a horizontal position so that the action set can continuously work to get the rolled-up material extended by friction. The operator can take his time in replacing the run-out roll with a new one without interruption.

4 Claims, 4 Drawing Sheets

AUTOMATIC MATERIAL EXTENSION MACHINE

FIELD OF THE INVENTION

The present invention relates to an automatic abutment type material extension machine which combines the advantages of the conventional abutment type and rotation type material extention machines. The present material extension machine is equipped with a abutment balance transmitter and an end joining device; the present invention can be operated continuously with high effeciency in an automatic manner.

Automation has realized an effective approach to cut down the cost of products, resulting in the improvement of product qualities and the increase of competition in the markets.

The present automatic material extension machine was developed on the idea and intended to provide an automatic continuous material extension machine disposed on a continuous production line. The present machine is mainly used to continuously draw out continually rolled up material for further processing, such as putting adhesive substance on the surface of a layer of polyester thin film, or printing the surface of a roll of wall paper or leather material. All such rolled up material must be extended first on the production line at factory for further processing; usually the tasks are performed manually.

The prior art material extension machine as shown in FIG. 1 is comprised of three rotatable rolls 701,702,703 mounted on a support frame 700. The rolled up material 600 is drawn outwardly continuously with the center of the roll as a pivot; when the roll 701 is run out, the operation must connect the initial end of the second roll 702 to the final end of the roll 701 and pivot the roll 702 to the operation position so that the rolled-up material can be extended continuously. However, the conventional way of extension of the rolled-up material has the following disadvantages:

1. the operation of the conventional machine needs more labor;
2. the extension force on the rolled up material is not evenly distributed as a result of the reduction of diameter of the action roll;
3. the end to end joining of the run-out roll to a stand-by roll is carried out by labor and the quality of the connection is not satisfactory.

SUMMARY OF THE INVENTION

The primary object of the present invention is to provide an automatic material extension machine which combines the abutment type and rotation type extension machines; wherein rolled-up material mounted on rolls is forcedly extended by power, and the external frame of rollers is able to be turned 180 degrees around for position shifting by gear sets with the horizontal brackets thereof kept in a horizontal position during the turnover operation so as to always keep the rolled-up material upon the rollers without interruption in operation.

One further object of the present invention is to provide an automatic material extension machine which is equipped with an automatic end-joining device having a sensor disposed at a place to detect the end of the rolled material so that an adhesive arm is actuated by a cylinder then to connect the front end of another stand-by roll to the end of the run-out roll.

To better illustrate the features and operation modes and the structure of the present invention, a number of drawings are presented in company with a preferred embodiment thereof, in which:

DETAILED DESCRIPTION OF THE PREFERRED EMBODIMENT

Figure 1:
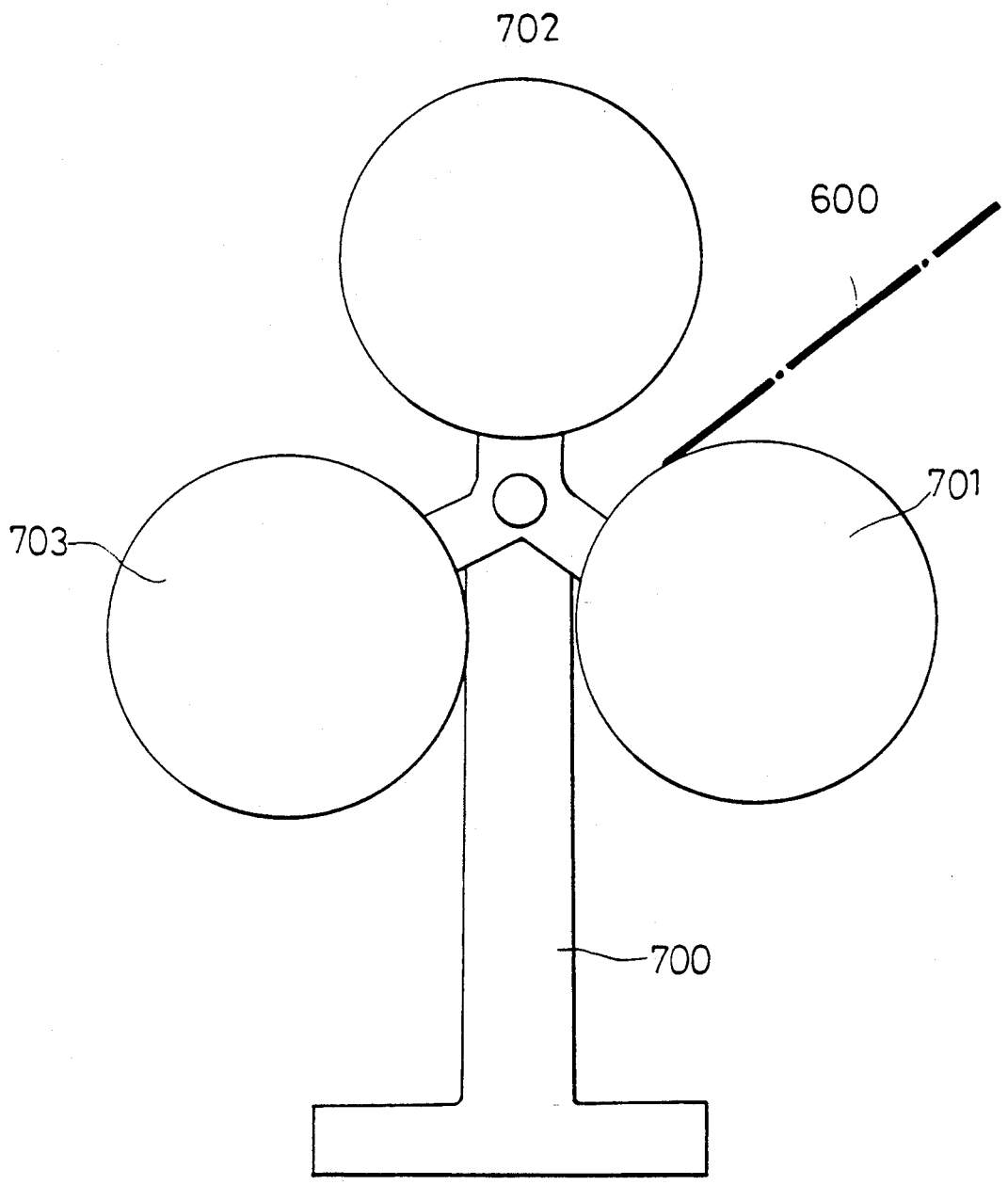
FIG. 1 is a diagram showing the prior art center type material extension machine.
Figure 2:
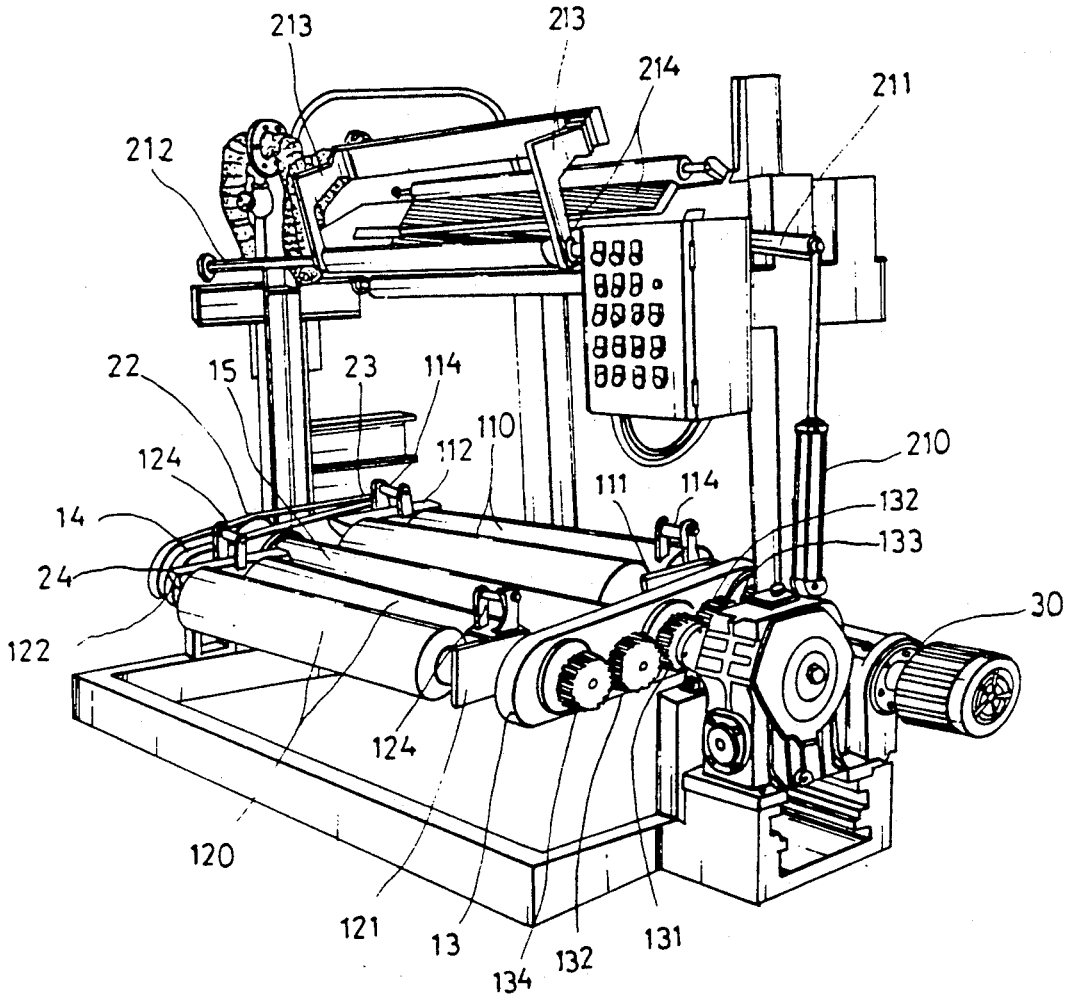
FIG. 2 is a perspective view of the present automatic material extension machine.
Figure 3:
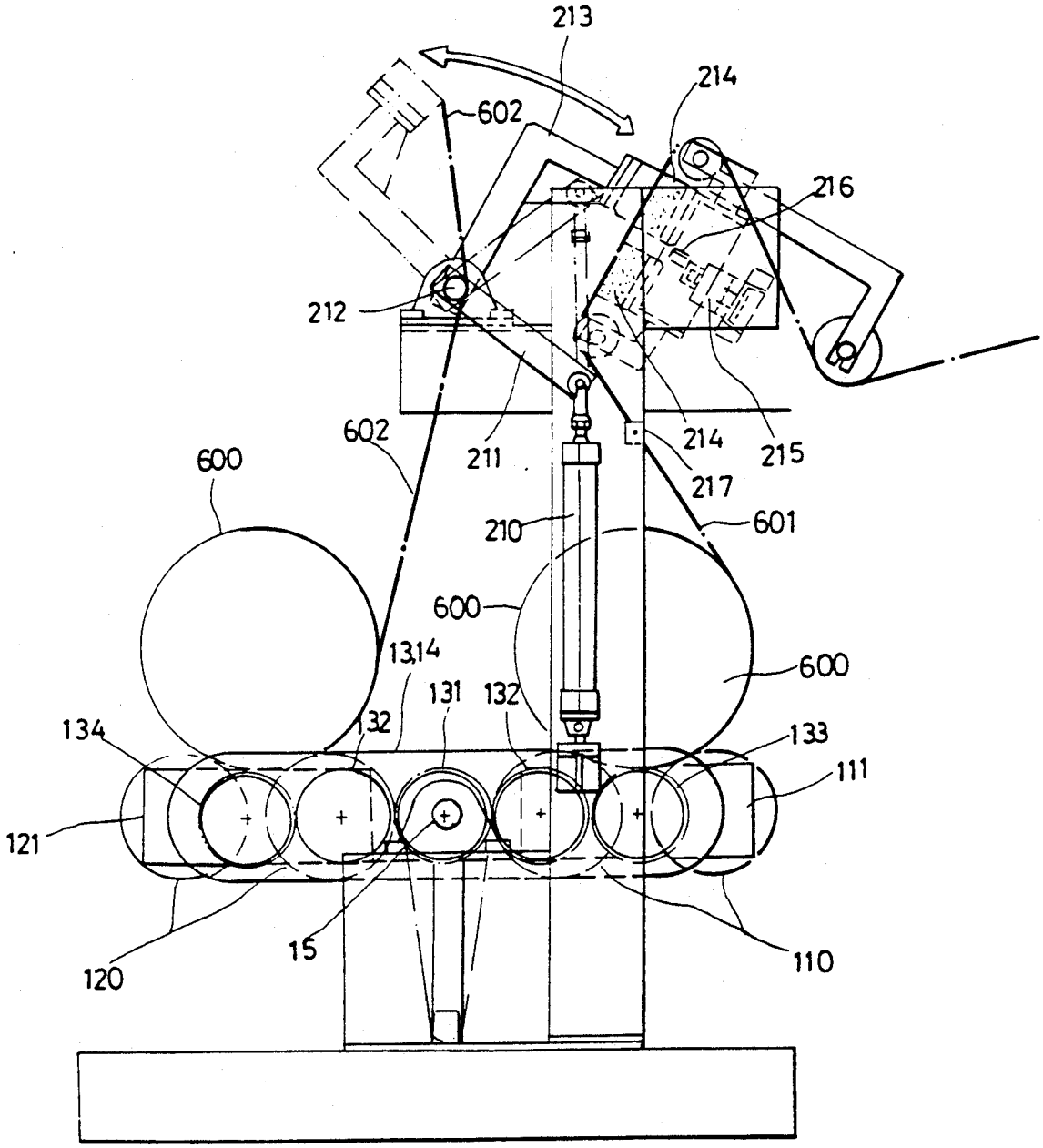
FIG. 3 is a plane sectional view of the present invention.

Referring to FIG. 2, the present invention is comprised of two sets of developing rollers 110, 120 wherein the roller set 110 is called the action set and the roller set 120 is called the stand-by set. Each of the above roller sets 110, 120 is equipped with two rotatable cylinders which are disposed between horizontal frames 111, 121 with shelter lid 112, 122 placed on one side thereof for protection of gear sets 113, 123 used to drive the rotatable cylinders. On both sides of the roller sets 110, 120 are disposed the clamp units 114, 124 which are able to hold the rolls of material in position on top of the cylinders of the roller sets respectively. Moreover, the roller sets 110, 120 are placed between the external frames 13, 14 which are able to be pivotably moved with the middle shaft 15 as the pivot by way of gear 131. Furthermore, on right top of the roller sets is disposed an automatic end joining device wherein a cylinder 210 is employed to actuate linkage 211 so as to make a pivot shaft 212 rotate. In the meanwhile, an adhesive arm 213 in association with the shaft 212 is made to rotate accordingly to become in abutting engagement with a suction plates 214, as shown in FIG. 3. The suction plates 214 are in connection to a vacuum pump (not shown) so that the rolled-up material 600 can be sucked by the suction plates 214.

A cutting means 216 powered by a pneumatically powered cylinder 215 is employed to cut off the extended material 600 when actuated by the same.

Figure 4:
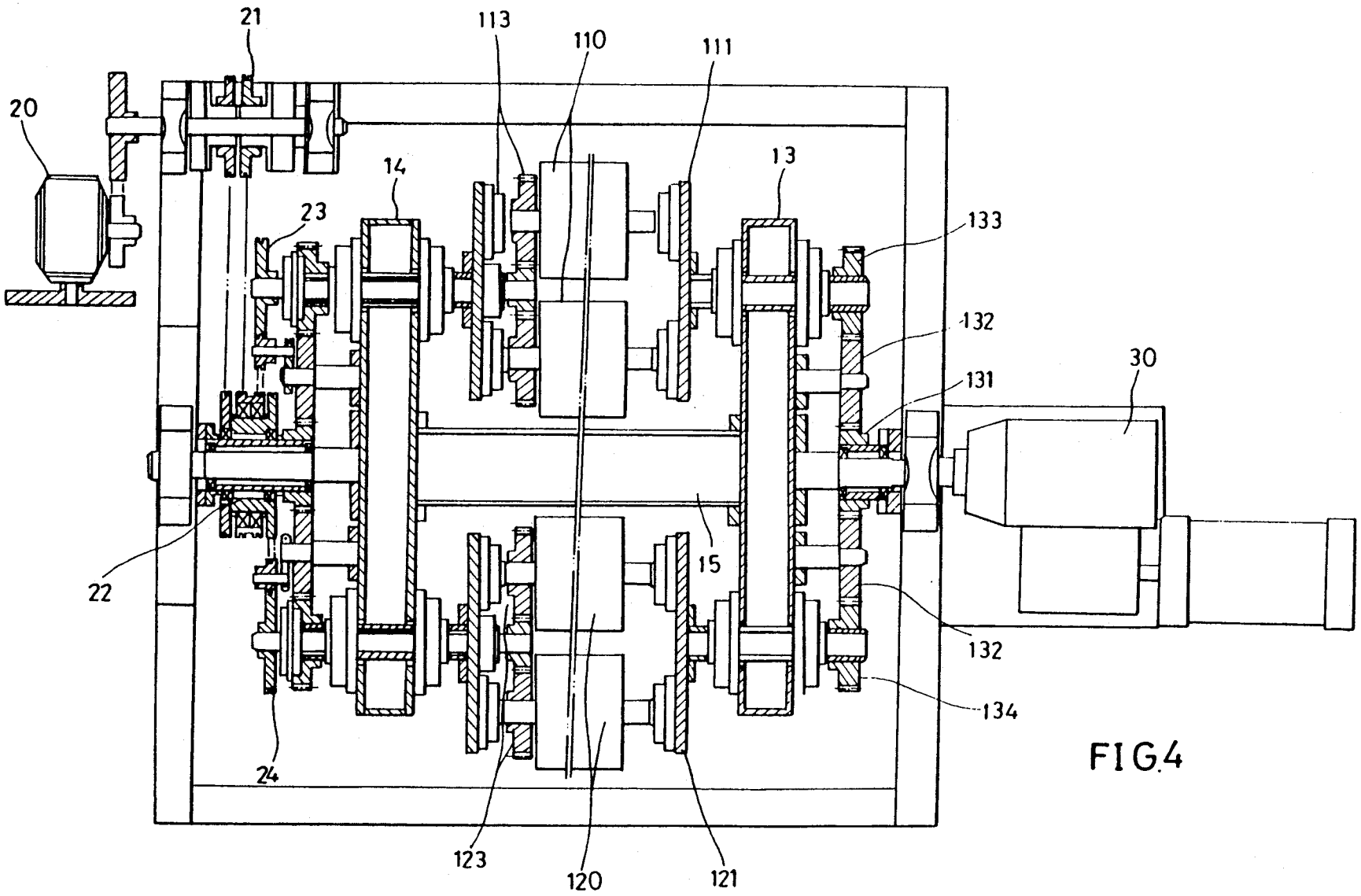
FIG. 4 is a sectional view showing the transmission mechanism of the present invention.

Referring to FIG. 4, a transmitter is shown. The roller sets 110, 120 are powered to rotate by way of a second motor 20 in connection to a belt assembly 21 as well as a clutch member 22 which is controlled by a relay and other necessary circuit components. Power produced thereby is only delivered to one of the roller sets 110, 120; the set driven is called an action set, and the roll of material 600 (see FIG. 3) disposed thereon can be extended continuously by frictional abutment. The roller sets 110, 120 are powered by way of the belt driven pulleys 23, 24 and the respective coaxially operated gear sets 113, 123.

Moreover, a first motor 30 having a driving shaft is engaged with a main drive gear 131 which is coupled to a pair of symmetric idle gears 132. The power produced is further transmitted to gears 133, 134 which in turn control the horizontal brackets 111, 121 of the developing roller sets 110, 120 respectively. The horizontal brackets 111, 121 are thereby made to turn over together with the external frame 13, 14 of the roller sets, driven by the main drive gear 131, so that the horizontal brackets 111, 121 are kept in contant horizontal position.

In the following, a detailed account of the operation mode of the present invention is presented. Rolls 600 having rolled up material 601, 602 disposed thereon are rotatably secured onto the developing roller sets 110, 120 by means of clamp units 114, 124 as shown in FIG. 3. The second motor 20, as shown in FIG. 4, is in driving relation with the pulley 23 by means of the clutch member 22, and the coaxially disposed gear set 113 is thereby able to actuate the roller set 110 to rotate, and the rolled up material 601 is extended upwardly by friction force and the material is developed along the wheels as shown in FIG. 3 for further processing; at this moment, the connecting rod of the piston 210 is in extension position, thereby the adhesion arm 213 is moved to a position as indicated by the dotted line in FIG. 3, and the rolled-up material 601 can be continuously smoothly developed outwardly.

The rolled up material 602 of the roll 600 disposed on the stand-by roller set 120 is held by the adhesive arm 213 at the initial end by suction; and the arm 213 is placed at a stand-by position. In the meanwhile, the power produced by the second motor 20 is not able to be transmitted to the pulley 24 because of the clutch 22 so that the stand by roller set 120 is kept motionless. When the material 601 of the roll 600 placed on the action set 110 runs out, the final end of the material 601 passes a sensor means 217, disposed on the structural frame of the present machine at a suitable position thereof, which is able to detect the state of completion and issue a signal to actuate the cylinder 210 and the first motor 30 to operate; meanwhile, the connecting rod of the piston 210 is withdrawn to make the adhesive arm 213 rotate clockwise, and then the suction plates 214 begin to work by actuating a vacuum pump to pump air out thereof so as to get the final end portion of the rolled-up material 601 held against the suction plates 214; thereby the initial end of the stand-by roll of material 602 can be joined to the final end of the action roll of material 601; and afterwards, a cylinder 215 is actuated to move a cutting device 216 to cut the excessive portion of the final end of the rolled up material 601 between the two suction plates to complete the joining of the two rolls.

Furthermore, the first motor 30 engaged with the main drive gear 131 is able to turn the external frames 13, 14, with the middle shaft 15 as the pivot, 180 degrees around; but the main drive gear 131 can simultaneously actuate the gears 133, 134 by way of the idle gears 132 to rotate in a reverse direction in equal amount of degrees so that the horizontal frames 111, 121 can remain in a horizontal position as the external frames 13, 14 is being turned 180 degrees around, i.e., the rolls 600 are always kept on top of the roller set 110, 120 for normal operation.

When the sensor means 217 detects the completion of the roll in action, and makes the stand by rolled material 602 joined to the end of the rolled material 601, the clutch member 22 begins to engage with the pulley 24 in one aspect and to disengage with the pulley 23 in other aspect so as to stop the rotation of the roller set 110. Meanwhile, the cylinders of the stand-by roller set 120 are driven by gear set 123 to rotate and continues to make the rolled up material 602 of a roll 600 to extend by friction. At the same time, the external frames 13, 14 are forced to turn around by the main drive gear 131, causing the change of position of stand by roller set 120 with the roller set 110 for continual operation.

After the action roller set 110 is moved to the position of the stand by roller set 120, an operator can take his time in placing a new roll of material thereon and attach the initial end thereof to the adhension arm 213 ready for next operation.

One point worthy of notice is the adoption of a dancing roller to adjust the tension of the extended material so that when the material is held by suction plates 124 for connection, the whole operation of extending the material by friction will not stop.

It can be apparently shown that the present invention can overcome the disadvantages of the prior art material extension machines and make the operation more automatic with less labor needed., and the connection between rolls becomes more accurate.

I claim:

1. An automatic material extension machine for feeding material from a first feeder roll and joining an initial end of said material from a first standby roll to a terminal end of said material from said first feeder roll, thereby providing a means for continuous feed of said material, said machine comprising, a base, an external frame rotatably mounted to said base, two developing roller set means for respectively cradling said first feeder roll and said first standby roll, said two roller set means rotatably mounted to said external frame, a first motor, belt, clutch and gear means operated by said first motor for alternately driving one or the other of said roller set means to feed said material from said first feeder roll, a second motor, driving and gear means operated by said second motor for, 1) 180° rotation of said external frame, 2) maintaining said two roller set means and said first feeder roll and said first standby roll cradled thereon in a horizontal plane, 3) disengaging a drive of said one or the other of said roller set means when initiating said 180° rotation of said external frame, and 4) engaging said drive of said one or the other of said roller set means when ending the 180° rotation of said external frame, an end joining means mounted on said base for joining said initial end of said material from said first standby roll to said terminal end of said material from said first feeder roll, said initial end of said material from said standby roll removably attached to said end joining means when said first feeder roll is feeding material, sensor and actuating means proximate to a feeder roll for identifying said terminal end of said material from said feeder roll and simultaneously actuating, 1) said end joining means to join said initial end of material to said terminal end of material, and 2) said second motor to rotate said external frame 180°, wherein said first motor operates said belt, clutch and gear means to drive said first feeder roller to feed said material until said sensor and actuating means identifies said terminal end of said material and actuates said end joining means and said second motor, wherein said roller set means cradling the spent first feeder roll is disengaged from said drive and moved to a position previously occupied by said roller set means cradling said first standby roll thereby permitting manual removal and replacement of said spent feeder roll by another standby roll with said material while said first standby roll simultaneously becomes a new feeder roll when said initial end of said material is joined to said terminal end of said material and said drive for said roller set means on which said new feeder roller is cradled is engaged by said belt, clutch and gear means.

2. The automatic material extension machine of claim 1, further comprising, clamp means engaged to said two developing roller set means for holding said first feeder roll and said first standby roll on said two roller set means.

3. The automatic material extension machine of claim 2, wherein said two developing roller set means each have two cylinders rotatably mounted in a horizontal frame, said horizontal frame being rotatably mounted on said external frame.

4. The automatic material extension machine of claim 3, wherein, said end joining means comprises, two suction plates, one of said two suction plates mounted on rotating arms, said arms actuated by said sensor and actuating means to rotate said one of said two suction plates into engagement with the other of said two suction plates, wherein said initial end of said material is joined to said terminal end of said material between said two suction plates.

* * * * *